US008585746B2

(12) United States Patent
Ilcheva et al.

(10) Patent No.: US 8,585,746 B2
(45) Date of Patent: Nov. 19, 2013

(54) ARTICLE OF APPAREL FOR TEMPERATURE MODERATION

(75) Inventors: Irena Ilcheva, Beaverton, OR (US); Edward L. Harber, Portland, OR (US); Kirk M. Mayer, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 1818 days.

(21) Appl. No.: 11/847,133

(22) Filed: Aug. 29, 2007

(65) Prior Publication Data

US 2009/0062892 A1 Mar. 5, 2009

(51) Int. Cl.
*A61F 7/00* (2006.01)

(52) U.S. Cl.
USPC ..... 607/108

(58) Field of Classification Search
USPC ..... 607/108
See application file for complete search history.

(56) References Cited

U.S. PATENT DOCUMENTS

| | | | | |
|---|---|---|---|---|
| 2,403,676 A | | 7/1946 | Modlinski | |
| 3,950,789 A | | 4/1976 | Konz et al. | |
| 4,294,244 A | * | 10/1981 | Pasternack | 128/202.26 |
| 4,525,875 A | | 7/1985 | Tomczak | |
| 4,575,097 A | | 3/1986 | Brannigan et al. | |
| 4,601,067 A | | 7/1986 | Buonassissi | |
| 4,856,294 A | * | 8/1989 | Scaringe et al. | 62/259.3 |
| 4,989,267 A | | 2/1991 | Watson | |
| 5,072,455 A | | 12/1991 | St. Ours | |
| 5,146,625 A | | 9/1992 | Steele et al. | |
| 5,305,471 A | | 4/1994 | Steele et al. | |
| 5,415,222 A | * | 5/1995 | Colvin et al. | 165/46 |
| 5,480,418 A | | 1/1996 | Zeoli-Jones | |
| 5,484,448 A | | 1/1996 | Steele et al. | |
| 5,524,293 A | | 6/1996 | Kung | |
| 5,606,746 A | | 3/1997 | Shelton et al. | |
| 5,692,238 A | | 12/1997 | Watson, Jr. | |
| 5,755,110 A | | 5/1998 | Silvas | |
| 6,185,742 B1 | | 2/2001 | Doherty | |
| 6,185,744 B1 | | 2/2001 | Poholski | |
| 6,189,149 B1 | | 2/2001 | Allen | |
| 6,230,501 B1 | * | 5/2001 | Bailey et al. | 62/51.1 |
| 6,298,907 B1 | * | 10/2001 | Colvin et al. | 165/46 |
| 6,328,618 B1 | * | 12/2001 | Fleischli | 441/106 |

(Continued)

FOREIGN PATENT DOCUMENTS

| | | |
|---|---|---|
| DE | 202006001749 | 3/2006 |
| EP | 0490347 A1 | 6/1992 |
| JP | 11217707 | 8/1999 |
| WO | WO9966809 | 12/1999 |

OTHER PUBLICATIONS

International Search Report and Written Opinion for PCT/US2008/070064, mailed Oct. 28, 2008.

(Continued)

*Primary Examiner* — Linda Dvorak
*Assistant Examiner* — Kaitlyn Smith
(74) *Attorney, Agent, or Firm* — Plumsea Law Group, LLC

(57) ABSTRACT

An article of apparel may include a polymer chamber element that defines an interior void for containing a substance in either a liquid or a solid state. Depending upon the substance located within the chamber element, the apparel may be utilized for increasing or decreasing the body temperature of the individual. The chamber element may have a plurality of subchambers, which may have a triangular shape and may be in fluid communication. In some configurations, the subchambers may have different sizes or volumes.

20 Claims, 20 Drawing Sheets

(56) References Cited

U.S. PATENT DOCUMENTS

| | | | | |
|---|---|---|---|---|
| 6,330,479 | B1 * | 12/2001 | Stauffer | 607/101 |
| D455,537 | S | 4/2002 | Fyfe | |
| 6,551,347 | B1 * | 4/2003 | Elkins | 607/104 |
| 6,942,015 | B1 * | 9/2005 | Jenkins | 165/46 |
| 6,957,697 | B2 * | 10/2005 | Chambers | 165/297 |
| 7,373,969 | B2 * | 5/2008 | Chambers | 165/297 |
| 7,546,853 | B2 * | 6/2009 | Rock et al. | 139/391 |
| RE42,238 | E * | 3/2011 | Courtney et al. | 405/186 |
| 7,980,242 | B1 * | 7/2011 | Wilhelm | 126/263.07 |
| 8,240,300 | B1 * | 8/2012 | Wilhelm | 126/263.07 |
| 2002/0144343 | A1 * | 10/2002 | Kuiper et al. | 5/81.1 R |
| 2003/0208831 | A1 * | 11/2003 | Lazar et al. | 2/69 |
| 2004/0258481 | A1 * | 12/2004 | Courtney et al. | 405/186 |
| 2005/0223465 | A1 * | 10/2005 | Williams et al. | 2/102 |
| 2005/0278823 | A1 * | 12/2005 | Bruce | 2/102 |
| 2006/0201178 | A1 * | 9/2006 | Smolko et al. | 62/259.3 |
| 2008/0141696 | A1 * | 6/2008 | Fuchs | 62/259.3 |
| 2009/0062892 | A1 * | 3/2009 | Ilcheva et al. | 607/108 |
| 2010/0251451 | A1 * | 10/2010 | Feldman et al. | 2/2.5 |
| 2011/0022137 | A1 * | 1/2011 | Ennis-Thomas et al. | 607/108 |
| 2012/0246788 | A1 * | 10/2012 | Harrell et al. | 2/2.5 |

OTHER PUBLICATIONS

Office Action mailed Nov. 17, 2010 for European Patent Application No. 087818464.4.

Communication pursuant to Article 94(3) EPC in EPO Application No. 08781846.4, mailed Nov. 17, 2010.

Communication pursuant to Article 94(3) EPC in EPO Application No. 08 781 846.4-1256, mailed Apr. 29, 2011.

* cited by examiner

ARTICLE OF APPAREL FOR TEMPERATURE MODERATION

BACKGROUND

The body temperature of an individual has a significant effect upon the athletic performance of the individual when engaging in athletic activities. Components of the body temperature include core temperature and surface temperature, for example. Whereas the core temperature is associated with interior portions of the individual (i.e., the internal organs), the surface temperature is a measure of the temperature associated with the surface of the individual (i.e., the skin). Although the core temperature and surface temperature are discrete measurements and may vary significantly, the core temperature has an effect upon the surface temperature, and the surface temperature has a corresponding effect upon the core temperature.

As the individual begins engaging in an athletic activity, including either practice sessions or competitions, the core temperature of the individual may rise as the level of athletic activity increases, particularly in relatively hot or humid climates. Although a rise in core temperature is a normal aspect of engaging in athletic activities, the athletic performance of the individual begins to decrease once the core temperature increases above a threshold temperature that may vary for different individuals. For example, the speed of the individual when running, the height of the individual when jumping, the reaction time of the individual when responding to other athletes, and the overall strength of the individual may decrease as the core temperature increases beyond the threshold temperature. The threshold temperature at which athletic performance decreases may be approximately 39 degrees Celsius (i.e., 102 degrees Fahrenheit), but varies between different individuals. Accordingly, moderating or otherwise delaying a rise in the core temperature during an athletic activity has the potential to reduce heat stress and increase the overall athletic performance of the individual.

SUMMARY

An article of apparel may include a polymer chamber element that defines an interior void for containing a substance in either a liquid or a solid state. Depending upon the substance located within the chamber element, the apparel may be utilized for increasing or decreasing the body temperature of the individual. In some configurations the apparel may be a vest, but may also be other types of apparel. The chamber element may have a plurality of subchambers, which may have a triangular shape and may be in fluid communication. In some configurations, the subchambers may have different sizes or volumes. A separation layer may be positioned adjacent to a surface of the chamber element and located to extend between the chamber element and an individual when the apparel is worn, and an insulating layer may be positioned opposite the separation layer and located to form an exterior surface of the apparel when the apparel is worn.

The advantages and features of novelty characterizing aspects of the invention are pointed out with particularity in the appended claims. To gain an improved understanding of the advantages and features of novelty, however, reference may be made to the following descriptive matter and accompanying drawings that describe and illustrate various embodiments and concepts related to the invention.

DESCRIPTION OF THE DRAWINGS

The foregoing Summary and the following Detailed Description will be better understood when read in conjunction with the accompanying drawings.

DETAILED DESCRIPTION

Figure 1:
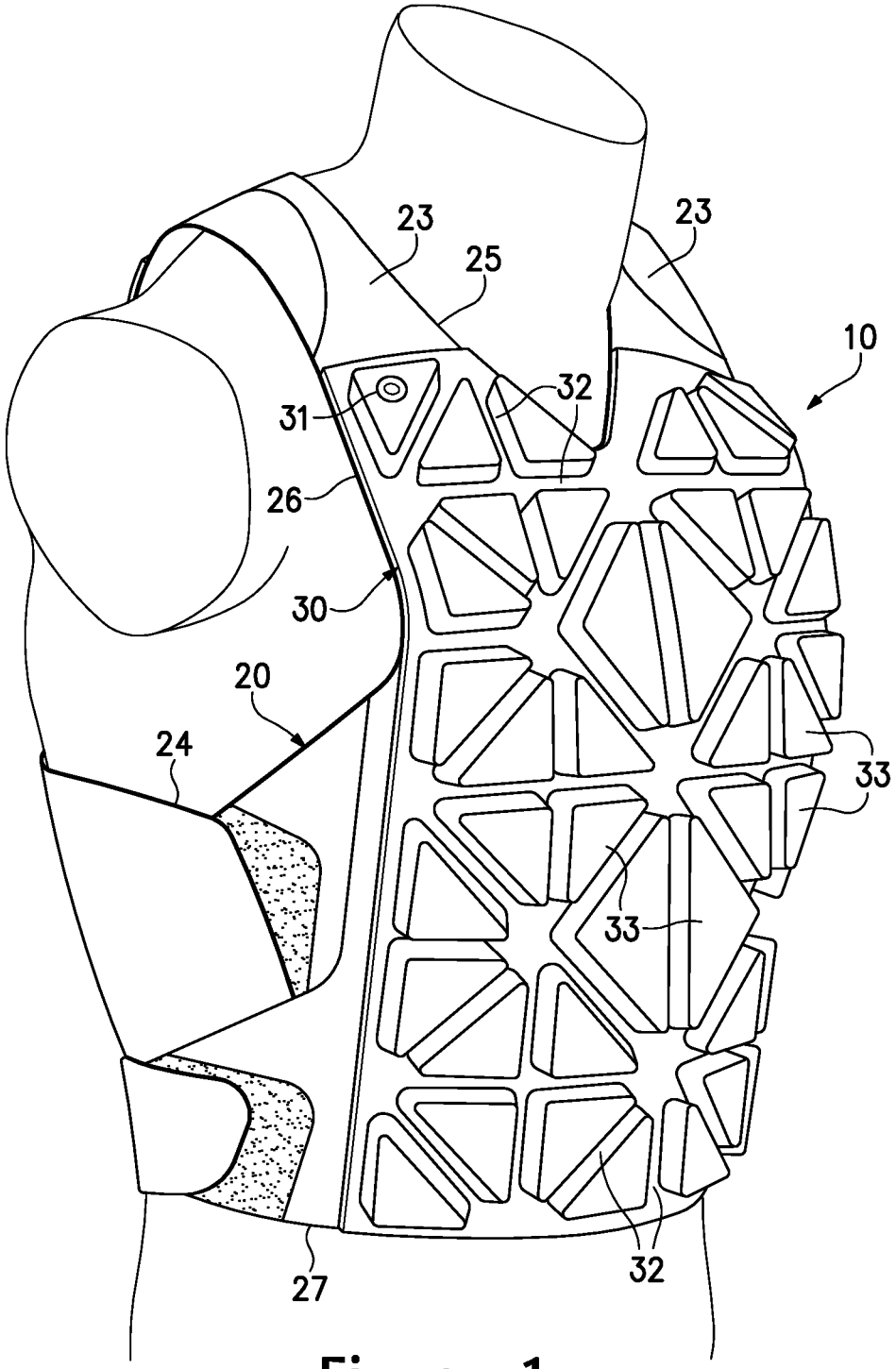
FIG. 1 is a perspective view of an individual wearing an article of apparel for temperature moderation.
Figure 2:
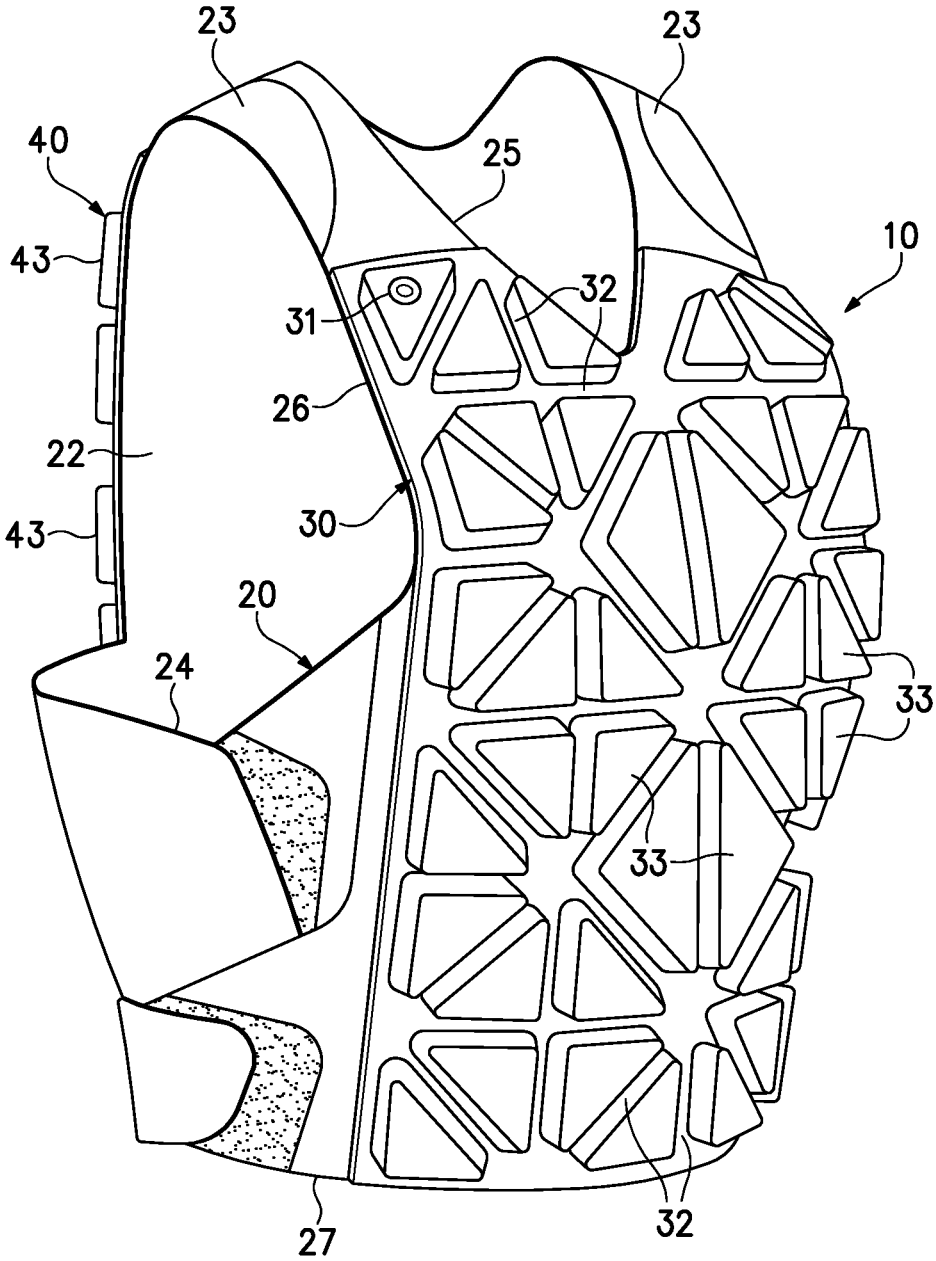
FIG. 2 is a perspective view of the article of apparel.
Figure 3:
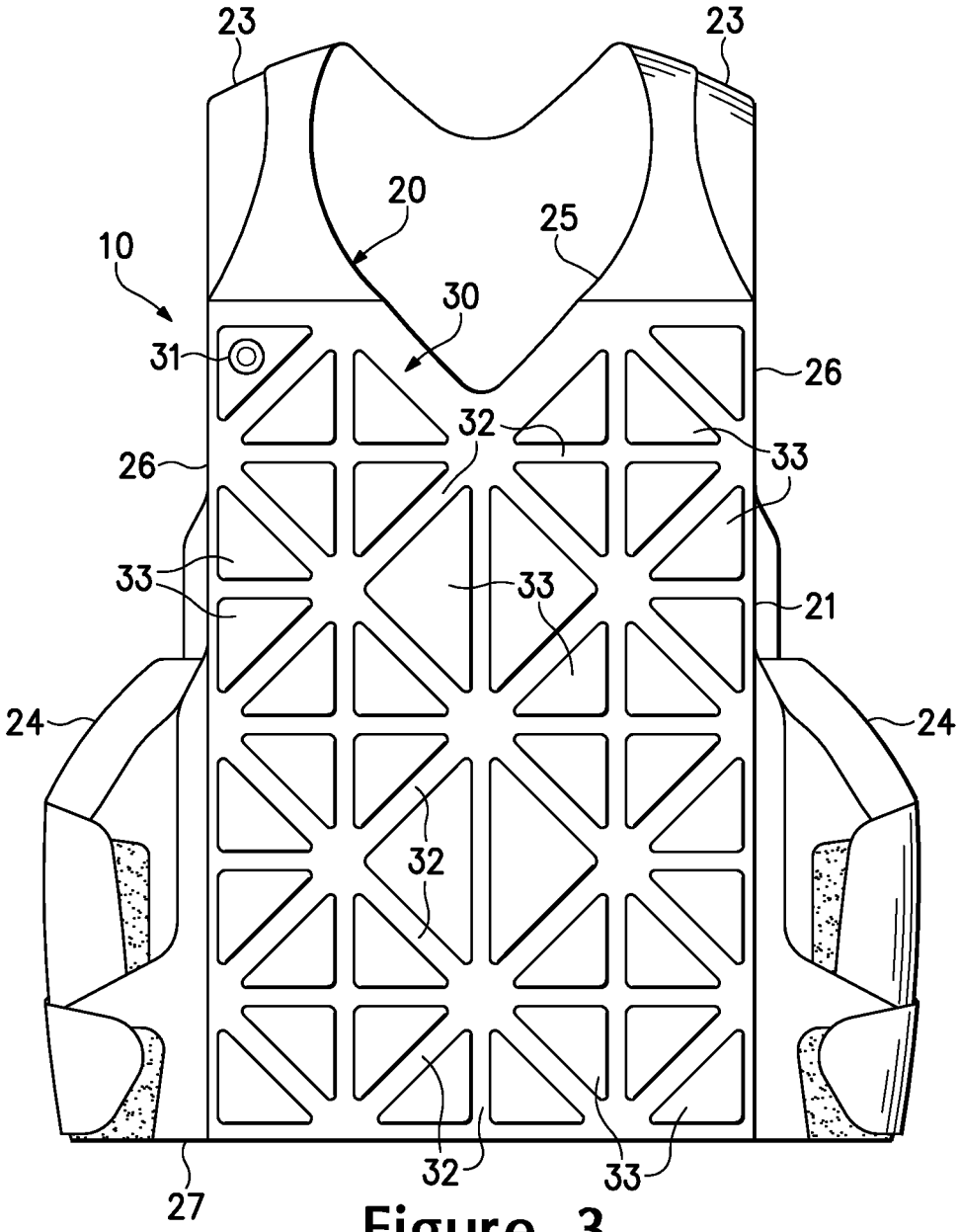
FIG. 3 is a front elevational view of the article of apparel.
Figure 4:
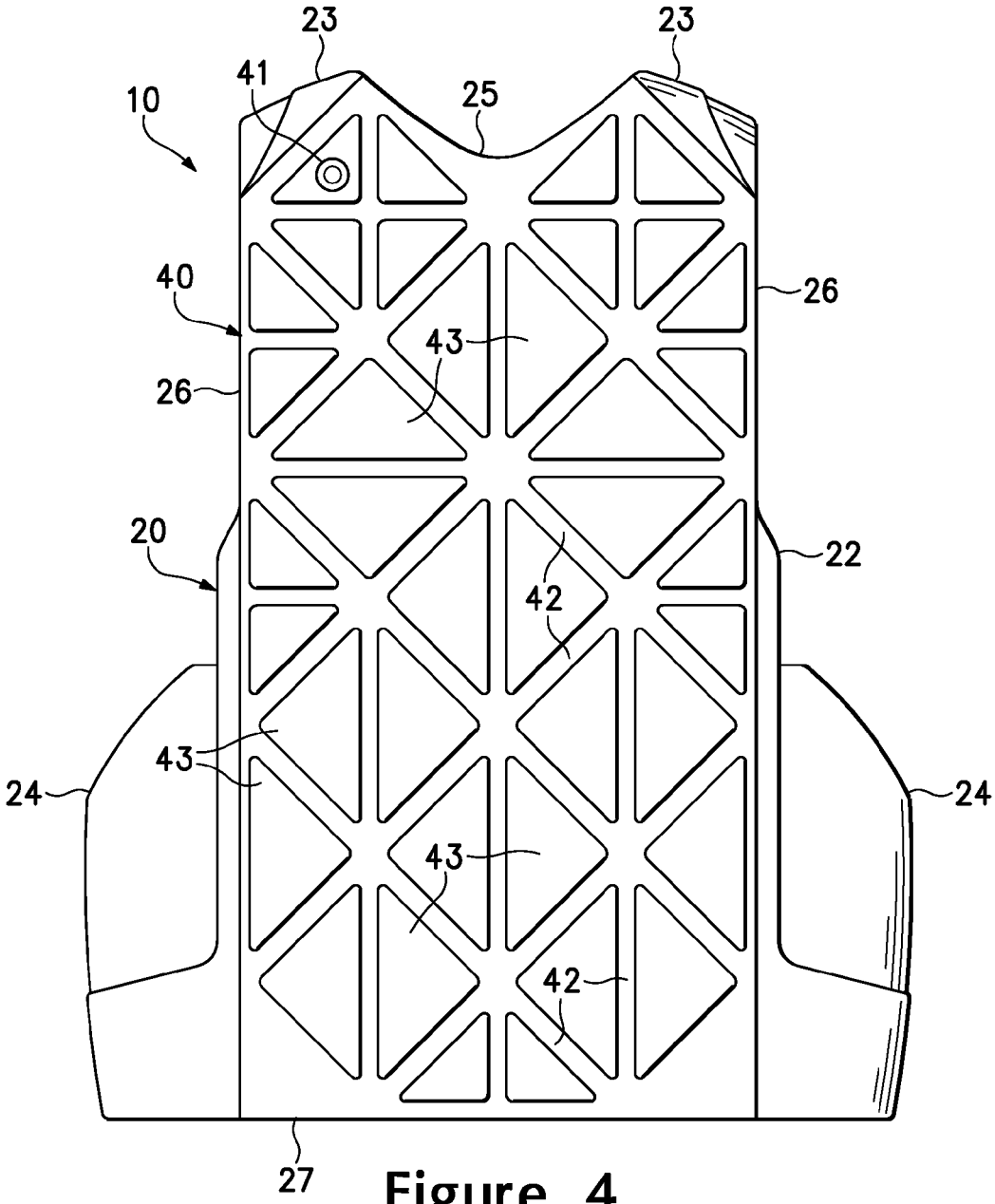
FIG. 4 is a rear elevational view of the article of apparel.
Figure 5:
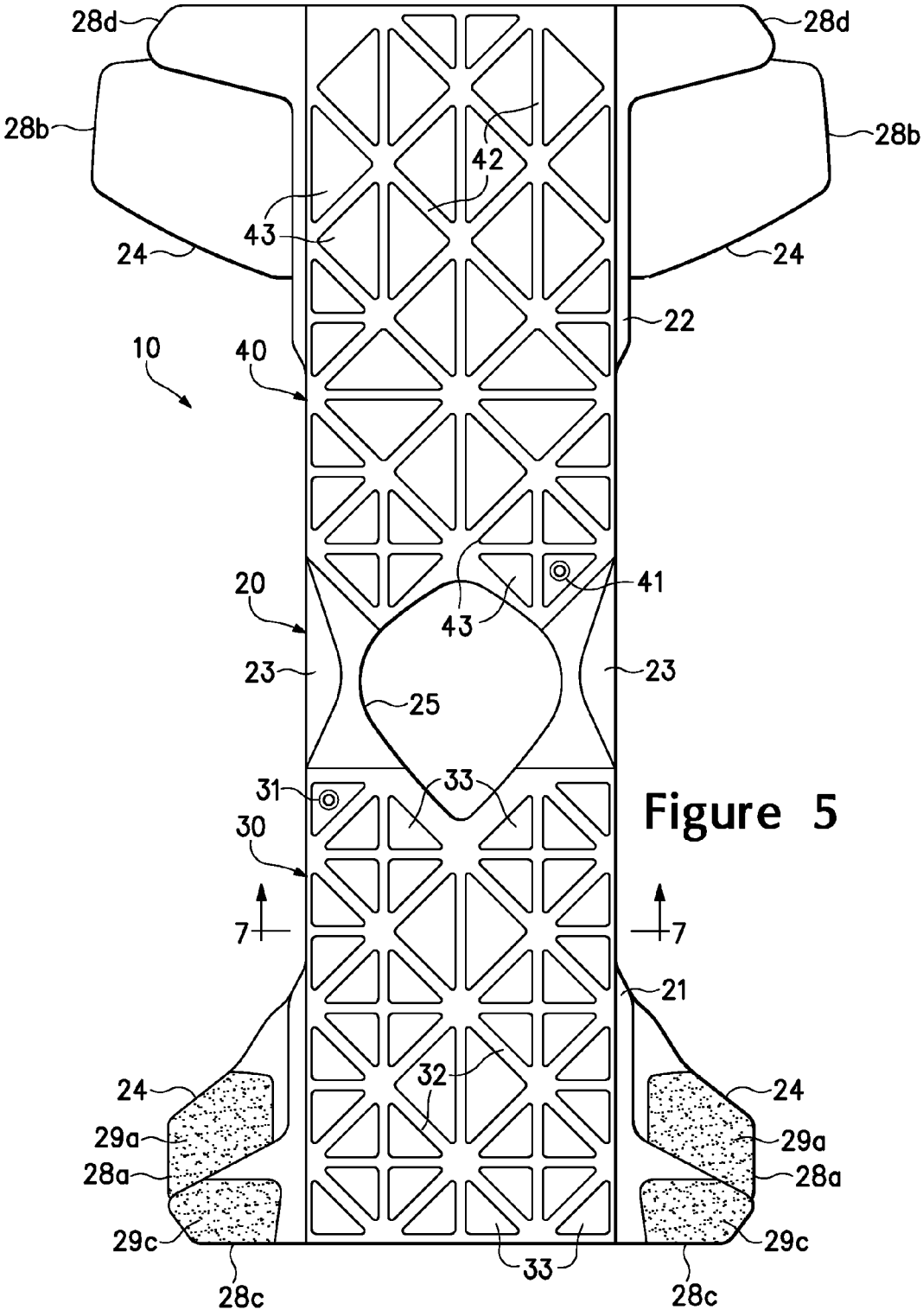
FIG. 5 is a top plan view of the article of apparel in a flat configuration.
Figure 6:
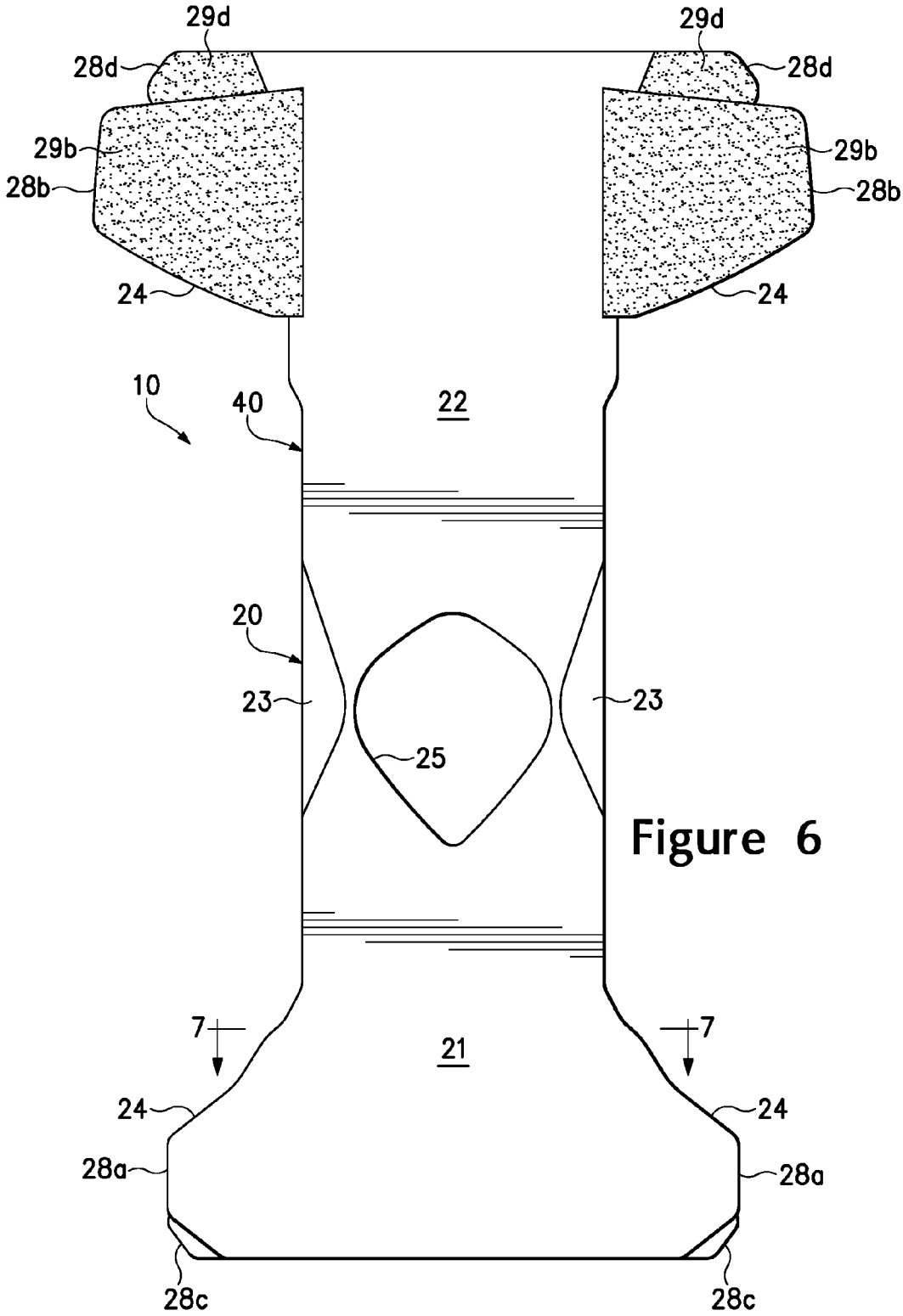
FIG. 6 is a bottom plan view of the article of apparel in the flat configuration.

The following discussion and accompanying figures disclose various apparel configurations for moderating the body temperature (i.e., at least one of the core temperature and the surface temperature) of an individual. In one example, the apparel is disclosed as having the configuration of a vest that covers a torso area of the individual, but may also have the configuration of a shirt or jacket. Concepts associated with the apparel may also be incorporated into a variety of other apparel types, including headwear, pants, shorts, and footwear, for example. In addition, concepts associated with the apparel may be incorporated into apparel having the configuration of therapeutic coverings or braces for a neck, elbow, knee, ankle, or spine, for example. Accordingly, the various apparel configurations disclosed in the following discussion and accompanying figures are intended to provide examples of the plurality of apparel configurations that may incorporate concepts associated with apparel for moderating the body temperature of an individual.

An article of apparel 10 is depicted in FIGS. 1-7 as having the configuration of a vest that covers a portion of a torso area of an individual. The primary elements of apparel 10 are a substrate element 20, a front chamber element 30, and a rear chamber element 40. In general, substrate element 20 secures apparel 10 to the individual and positions each of chamber elements 30 and 40 relative to the individual. Chamber elements 30 and 40 are secured to an exterior of substrate element 20 and each define an interior void for containing a substance that may be heated or cooled to moderate the body temperature of the individual. Although a variety of substances may be utilized within chamber elements 30 and 40, the substance will be discussed below as being water for purposes of example.

Prior to athletic activities, including competitions or practice sessions, apparel 10 may be utilized to reduce the body temperature of the individual. More particularly, apparel 10 and the water within chamber elements 30 and 40 may be refrigerated or otherwise cooled. The individual may then wear apparel 10 in order to reduce the body temperature prior to engaging in the athletic activity. As discussed above, the body temperature of the individual may rise as the level of athletic activity increases. By utilizing apparel 10, the body temperature of the individual may be decreased prior to engaging in the athletic activity. Moderating or otherwise delaying a rise in the body temperature during the athletic activity has the potential to reduce heat stress, thereby increasing the overall athletic performance of the individual.

In some circumstances, the individual may benefit from raising the core temperature prior to engaging in the athletic activity. When an athletic activity involves relatively cold climates or conditions, for example, apparel 10 and the water within chamber elements 30 and 40 may be heated. The individual may then wear apparel 10 in order to increase the body temperature prior to engaging in the athletic activity. Similarly, this procedure may be utilized when the individual desires to retain the elevated body temperature that results from warming-up prior to engaging in an athletic activity.

In addition to enhancing the athletic performance of the individual, apparel 10 may be utilized to impart a therapeutic effect. More particularly, the water within chamber elements 30 and 40 may be heated or cooled in order to promote a corresponding change in the body temperature of the individual, as recommended by a medical professional. As an example, apparel 10 may be utilized to assist with reducing the body temperature of an individual with hyperthermia (e.g., heat exhaustion, heat stroke, or a fever), or apparel 10 may be utilized to assist with increasing the body temperature of an individual with hypothermia. As discussed in greater detail below, therapeutic coverings or braces for a neck, elbow, knee, ankle, or spine may be used to heat or cool specific portions of the body. Accordingly, the specific manner in which apparel 10 is utilized to moderate the body temperature of the individual may vary significantly depending upon the context of use and the desired change in body temperature.

Substrate element 20 extends between a torso area of the individual and each of chamber elements 30 and 40, thereby forming an interior portion of apparel 10 that is positioned to contact the individual. The material forming substrate element 20 has a configuration that extends around and generally conforms with the shape of the torso area. More particularly, substrate element 20 has a front torso area 21 that corresponds with the chest of the individual, a rear torso area 22 that corresponds with the back of the individual, a pair of shoulder areas 23 that extend over the shoulder of the individual, and a pair of side areas 24 that extend around sides of the individual. In addition, substrate element 20 defines a neck opening 25 that receives the neck of the individual, a pair of arm openings 26 through which arms of the individual extend, and a waist opening 27 that extends around the waist of the individual.

A variety of materials are suitable for substrate element 20, including various natural or synthetic textiles (e.g., knitted, woven, non-woven, tricot, spacer mesh), polymer sheets, and combinations thereof. Given that substrate element 20 contacts the individual when apparel 10 is worn, the materials of substrate element 20 may be selected to provide a comfortable interface between the individual and apparel 10. During use, substrate element 20 may be exposed to or saturated with water or other substances within chamber elements 20 and 30, as well as condensation from the exterior of chamber elements 30 and 40. The materials selected for substrate element 20 may, therefore, repel water or be comfortable when saturated with water. Accordingly, consideration may be given to the overall comfort and absorptivity of the material selected for substrate element 20.

As indicated above, apparel 10 may be utilized to cool or heat the individual. More particularly, heat may be transferred from the individual to chamber elements 30 and 40 when attempting to decrease the body temperature, or heat may be transferred from chamber elements 30 and 40 to the individual when attempting to increase the body temperature. The material forming substrate element 20 may, therefore, be selected to provide a desired degree of heat transfer. Depending upon the intended temperature of the water within chambers 30 and 40, apparel 10 may benefit from imparting insulative properties to substrate element 20. For example, the material forming substrate element 20 may provide some insulation to prevent the individual from cooling too rapidly or experiencing burns. Accordingly, consideration may be given to the insulative properties of the materials selected for substrate element 20.

When filled with ice, liquid water, or other substances, the mass of chambers 30 and 40 may be relatively large. In order to support chambers 30 and 40 through many uses of apparel 10, the material selected for substrate element 20 may exhibit a suitable durability. Additionally, the stretch properties of the material forming substrate element 20 may be considered to ensure that chambers 30 and 40 remain in contact with the torso area of the individual. Accordingly, consideration may be given to the durability and stretch properties of the materials selected for substrate element 20.

Based upon the above discussion, factors to consider when selecting the materials for substrate element 20 include comfort, absorptivity, insulative properties, durability, and stretch properties, for example. Although any of the general materials noted above and a range of additional materials may be utilized in substrate element 20, one example of a suitable material is a tricot textile with a polyurethane coating. Tricot textiles are manufactured through warp knitting, in which the yarn zigzags vertically, following a single column (i.e., wale) of knitting, rather than a single row (i.e., course). An advantage to tricot textiles and other similar textiles relate to its resistance to runs. Although a polyurethane coated tricot textile is suitable for substrate element 20, a variety of other textiles, coated textiles, impregnated textiles, reinforces textiles, and polymer sheets, for example, may also be utilized.

Substrate element 20 may be formed from multiple elements or a variety of different materials. For example, the materials forming shoulder areas 23 and side areas 24 may have greater stretch than torso areas 21 and 22 to enhance the comfort and fit of apparel 10. Similarly, each of shoulder areas 23 may be formed from both a stretch material and a non-stretch material in order to enhance comfort and also resist elongation due to the mass of the substance within chamber elements 30 and 40. As a further example, a majority of substrate element 20 may be formed from stretch materials, and edges of substrate element 20 (i.e., the edges defining openings 25-27) may be formed from non-stretch materials in order to resist deformation. Accordingly, the different materials forming substrate element 20 may be utilized to impart specific properties to different areas of substrate element 20.

Side areas 24 each include four flaps 28*a*-28*d* that are utilized to secure apparel 10 around the torso area of the individual and provide an adjustable fit to apparel 10. Flaps 28*a* extend outward and rearward from front torso area 21 and each include a fastener 29*a*. Flaps 28*b* extend outward and forward from rear torso area 22 and each include a fastener 29*b*. When worn, flaps 28*a* and 28*b* overlap each other such that fasteners 29*a* and 29*b* join with each other. Similarly, flaps 28*c* extend outward and rearward from front torso area 21 and each include a fastener 29*c*. Flaps 28*d* extend outward and forward from rear torso area 22 and each include a fastener 29*d*. When worn, flaps 28*c* and 28*d* overlap each other such that fasteners 29*c* and 29*d* join with each other. Whereas flaps 28*a* and 28*b* are positioned in contact with the individual, flaps 28*c* and 28*d* extend over flaps 28*a* and 28*b* and further secure the positions of flaps 28*a* and 28*b*. Although fasteners 29*a*-29*d* may be snaps, buttons, ties, magnetic elements, or mechanical interlocks, for example, fasteners 29*a*-29*d* are depicted as being hook-and-loop fastener systems that impart adjustability to the fit of apparel 10. The use of flaps 28*a*-28*d* and fasteners 29*a*-29*d* provide an example of a suitable system for securing apparel 10 to the individual. As alternatives, straps ties, or other fasteners may be used. In some configurations, side areas 24 may be absent such that apparel 10 merely hangs over the shoulders of the individual.

Front chamber element 30 is secured to front torso area 21 and is generally positioned to cover a majority of a front of the torso area of the individual. A void within front chamber element 30 is used to contain a substance, such as water, that may be heated or cooled to moderate the body temperature of the individual. In order to form an opening that provides access to the void, front chamber element 30 includes a plug 31 that may be removed to introduce the water into the void and remove the water from the void. Although plug 31 is depicted as being in an upper portion of front chamber element 30 and adjacent to one of shoulder areas 23, plug 31 may be located in a lower area or any other area of front chamber element 30.

Figure 7:
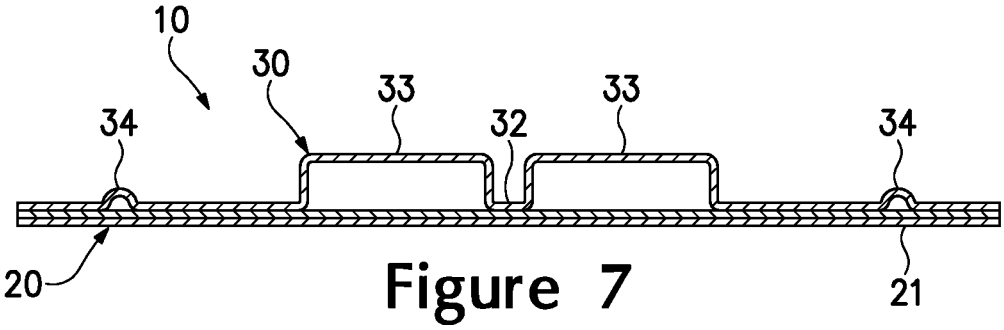
FIG. 7 is a cross-sectional view of the article of apparel, as defined by section line 7-7 in FIGS. 5 and 6.

A plurality of indentations 32 are formed in an outward-facing surface of front chamber element 30 to define or otherwise provide an outline of a plurality of triangular subchambers 33. Indentations 32 extend inward and toward an opposite surface of front chamber element 30. More particularly, indentations 32 or portions of indentations 32 extend entirely to the opposite surface and are bonded to the opposite surface. Various conduits 34, as depicted in FIG. 7, allow the water to flow between subchambers 33 to fill the void within chamber element 30. That is, conduits 34 provide passages for the water to pass through indentations 32 and into the various subchambers 33.

Indentations 32 have a generally linear configuration and are oriented to extend in various directions. More particularly, some of indentations 32 extend across chamber element 30 in a horizontal direction, other indentations 32 extend across chamber element 30 in a vertical direction, and a remainder of indentations 32 extend across chamber element 30 in one of two diagonal directions. These orientations for indentations 32 impart a triangular shape to subchambers 33. Although some of indentations 32 extend entirely across the width of front chamber element 30, other indentations 32 extend only a portion of the distance across the width of front chamber element 30. This configuration imparts a greater size or volume to some of subchambers 33. That is, some of the various subchambers 33 have different sizes due to the configuration of indentations 32.

Subchambers 33 form discrete areas within front chamber element 30 that receive a portion of the substance contained by front chamber element 30. An advantage to configuring front chamber element 30 in this manner is that indentations 32 form flexion areas in apparel 10. Whereas subchambers 33 are relatively thick portions of front chamber element 30, indentations 32 are relatively thin areas that promote flexing or bending. As discussed above, indentations 32 extend horizontally, vertically, and diagonally, thereby forming the flexion lines in corresponding directions. When water is utilized as the substance within front chamber element 30, the water may be frozen to form ice that promotes cooling in the body temperature of the individual. Although the ice within subchambers 33 may have a thickness that resists breaking, the ice within conduits 34 may be broken such that apparel 10 flexes at indentations 32 to conform with contours of the torso area of the individual.

The torso area of the individual is contoured in three dimensions, and some portions of the torso area are more curved than other portions. Similarly, some portions of the torso area are more planar than other portion. The degree to which different portions of front chamber element 30 should flex or otherwise bend in order to conform with the various contours of the torso area may vary throughout front chamber element 30. That is, some portions of front chamber element 30 may need to flex more than other areas in order to conform with the contoured configuration of the torso area of the individual. Based upon the above discussion, some of subchambers 33 have different sizes and indentations 32 form flexion areas in apparel 10. In general, the locations of indentations 32 and the resulting sizes of subchambers 33 are selected to provide (a) greater flex in portions of the torso area of the individual that are more curved and (b) lesser flex in portions of the torso area of the individual that are more planar. More particularly, subchambers 33 have lesser sizes in areas where greater flex is beneficial, and subchambers 33 have greater sizes in other areas. That is, the sizes of subchambers 33 are selected to impart more flex to areas of apparel 10 where additional flex is beneficial.

A wide range of polymer materials may be utilized for front chamber element 30. In selecting materials for front chamber element 30, engineering properties of the material (e.g., tensile strength, stretch properties, fatigue characteristics, dynamic modulus, and flexibility at different temperatures) as well as the ability of the material to prevent the diffusion of the substance contained by front chamber element 30 may be considered. When formed of thermoplastic urethane, for example, the material forming front chamber element 30 may have a thickness of approximately 1.0 millimeter, but the thickness may range from 0.25 to 2.0 millimeters or more, for example. In addition to thermoplastic urethane, suitable polymer materials for front chamber element 30 include polyurethane, polyester, polyester polyurethane, and polyether polyurethane, for example.

In addition to other substances, water may be utilized within the void in front chamber element 30. Advantages to water relates to availability and non-toxicity. Rather than transporting water within apparel 10 (e.g., while traveling to an athletic event), water may be added to apparel 10 through plug 31 at the location of the athletic event. The water may then be cooled to the desired temperature using a refrigerator or freezer, for example. In addition to being readily-available and non-toxic, an advantage to water is the latent heat associated with the phase change from a solid to a liquid. When water is a solid (i.e., ice), the amount of heat that the water absorbs during the transition from solid to liquid is relatively large, thereby drawing significant heat from the individual and promoting cooling of the body temperature. Although water is a suitable substance, a variety of other substances may be utilized within the void in front chamber element 30, including a saline solution, glycerin, or a paraffin solution, for example. In addition to liquids, various gels or solid materials may also be utilized within front chamber element 30.

Rear chamber element 40 is secured to rear torso area 22 and is generally positioned to cover a majority of a rear of the torso area of the individual. As with front chamber element 30, a void within rear chamber element 40 is used to contain a substance, such as water, that may be heated or cooled to moderate the body temperature of the individual. In order to form an opening that provides access to the void, rear chamber element 40 includes a plug 41 that may be removed to introduce the substance into the void and remove the substance from the void.

The general configuration of rear chamber element 40 is similar to the configuration of front chamber element 30. As such, a plurality of indentations 42 are formed in an outward-facing surface of rear chamber element 40 to define or otherwise provide an outline of a plurality of triangular subchambers 43. Indentations 42 have a generally linear configuration and are oriented to extend in various directions, including horizontal, vertical, and diagonal. These orientations for indentations 42 impart triangular shapes to the various subchambers 43. As with front chamber element 30, some of subchambers 43 have different sizes due to the configuration of indentations 42, and indentations 42 form flexion areas in apparel 10 that assist with conforming to the contours in the torso area of the individual. In order to permit water or other substances to flow between subchambers 43, rear chamber element 40 may incorporate conduits that are similar to conduits 34. Any of the materials discussed above for forming front chamber element 30 may also be utilized for rear chamber element 40, and any of the substances that are suitable for front chamber element 30 may also be utilized within the void in rear chamber element 40.

In comparison with front chamber element 30, the average size of subchambers 43 is larger in rear chamber element 40. A rationale for the differences in the sizes of subchambers 33 and 43 relates to the relative curvatures in the front and rear torso areas of the individual. Whereas the front torso area of the individual includes contours corresponding with the pectoral muscles, the rear torso area is more planar. Accordingly, rear chamber element 40 requires less flexibility than front chamber element 30 and exhibits a greater average size for subchambers 43.

Figure 8A:
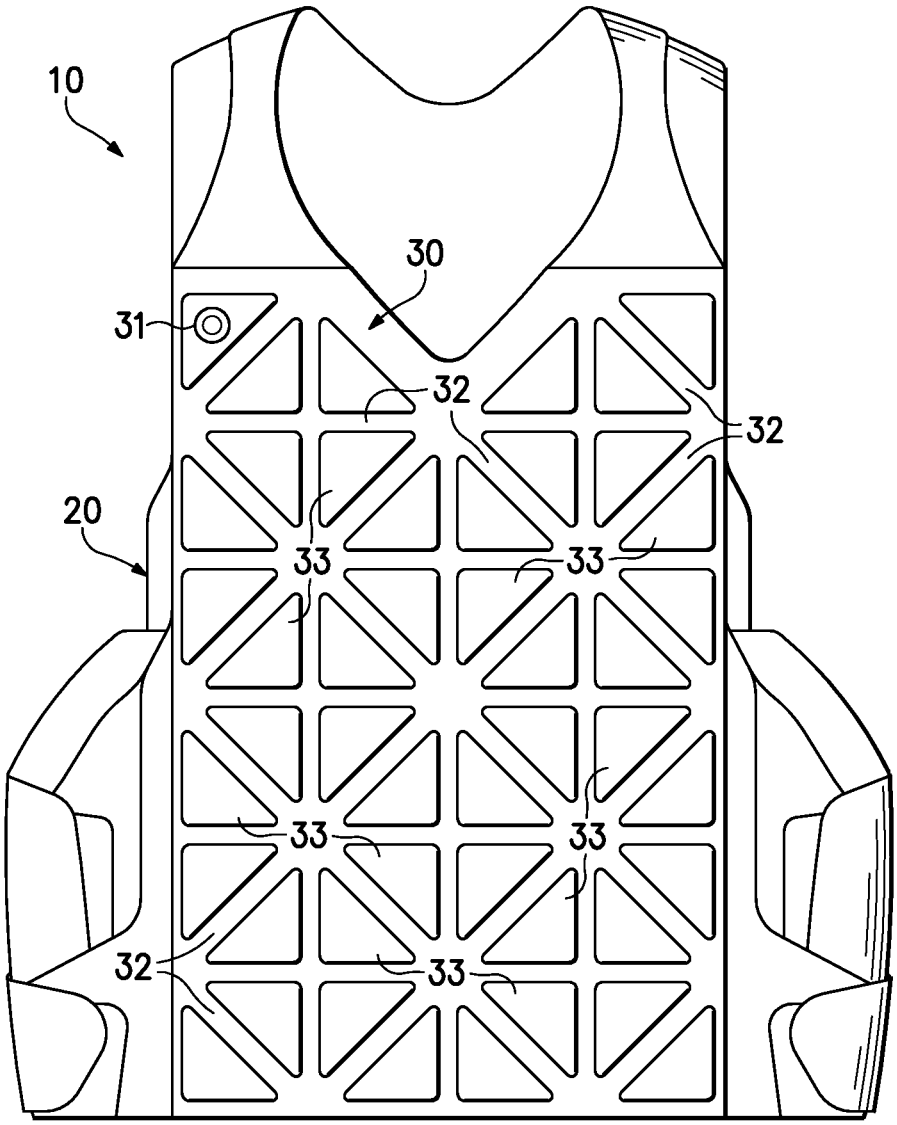
FIGS. 8A-8E are front elevational views corresponding with FIG. 3 and depicting additional configurations of the article of apparel.
Figure 8B:
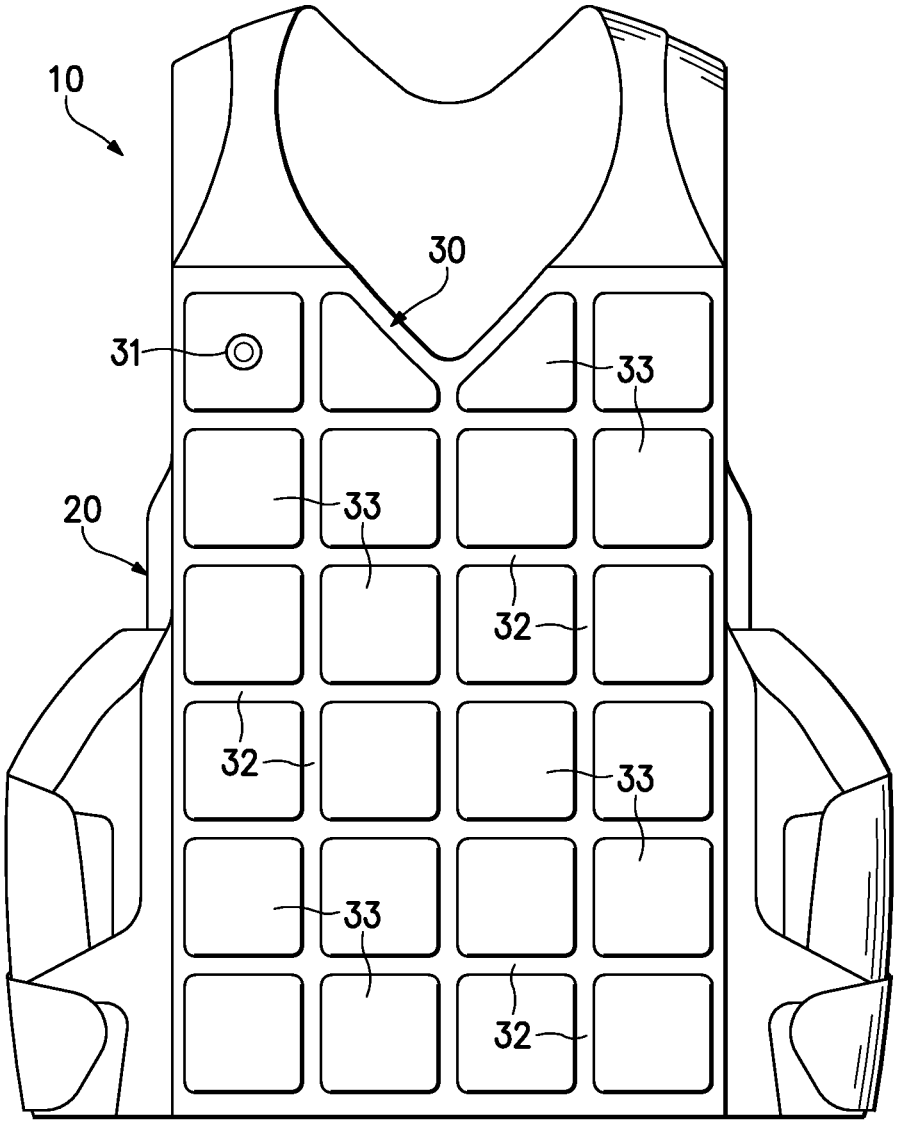
Figure 8C:
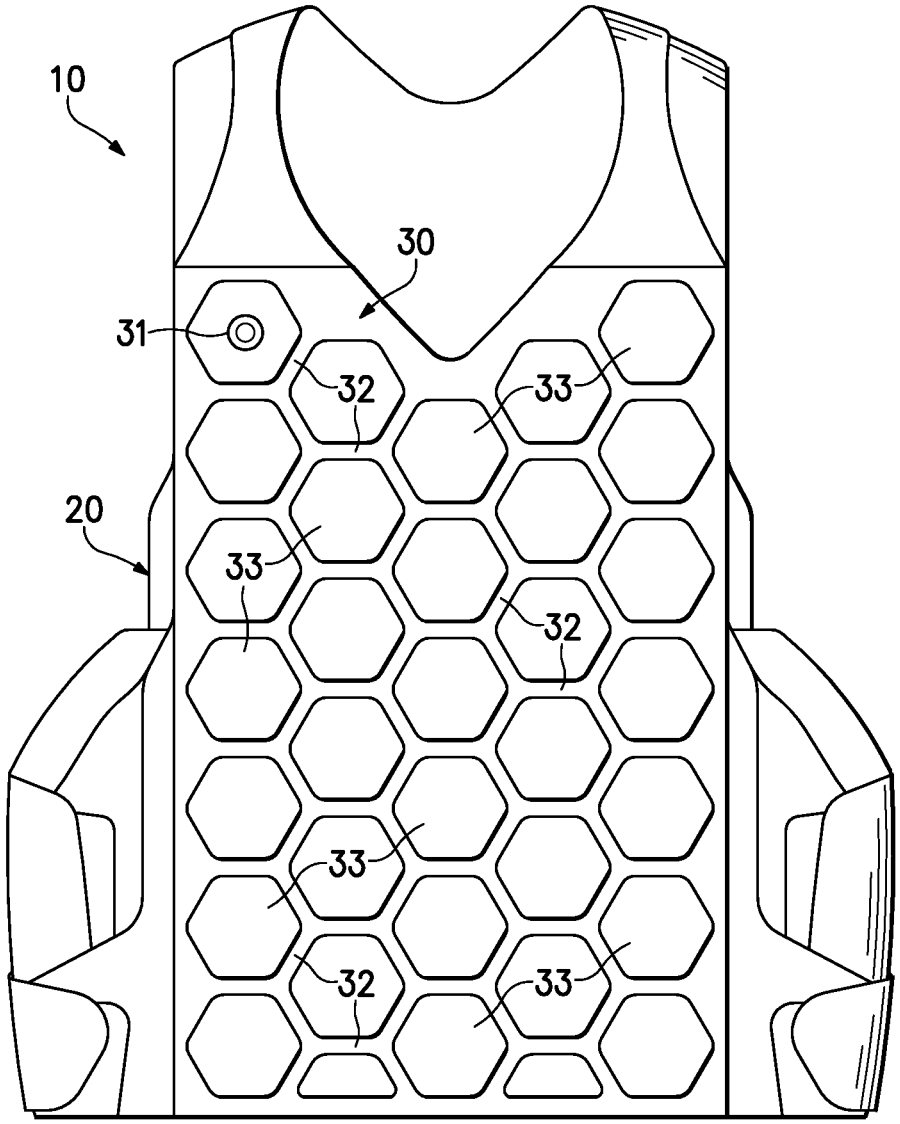
Figure 8D:
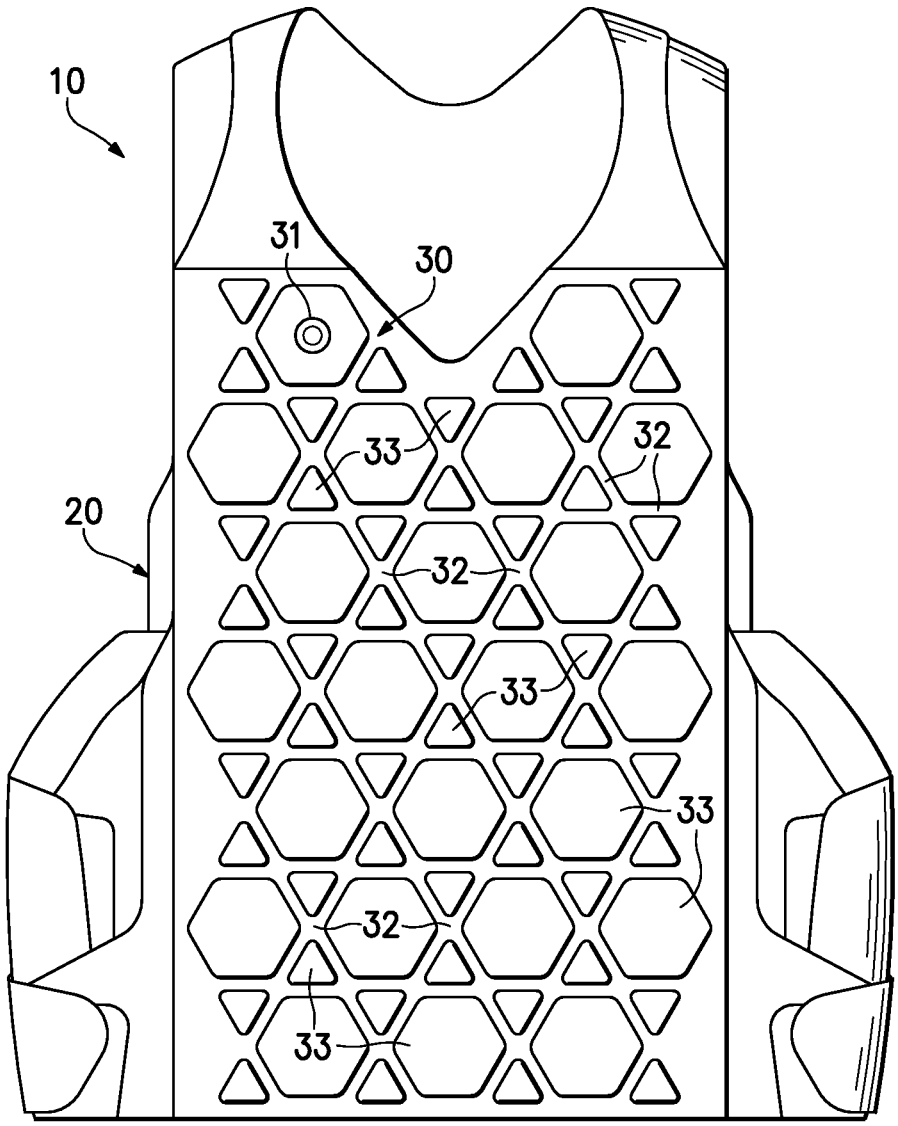
Figure 8E:
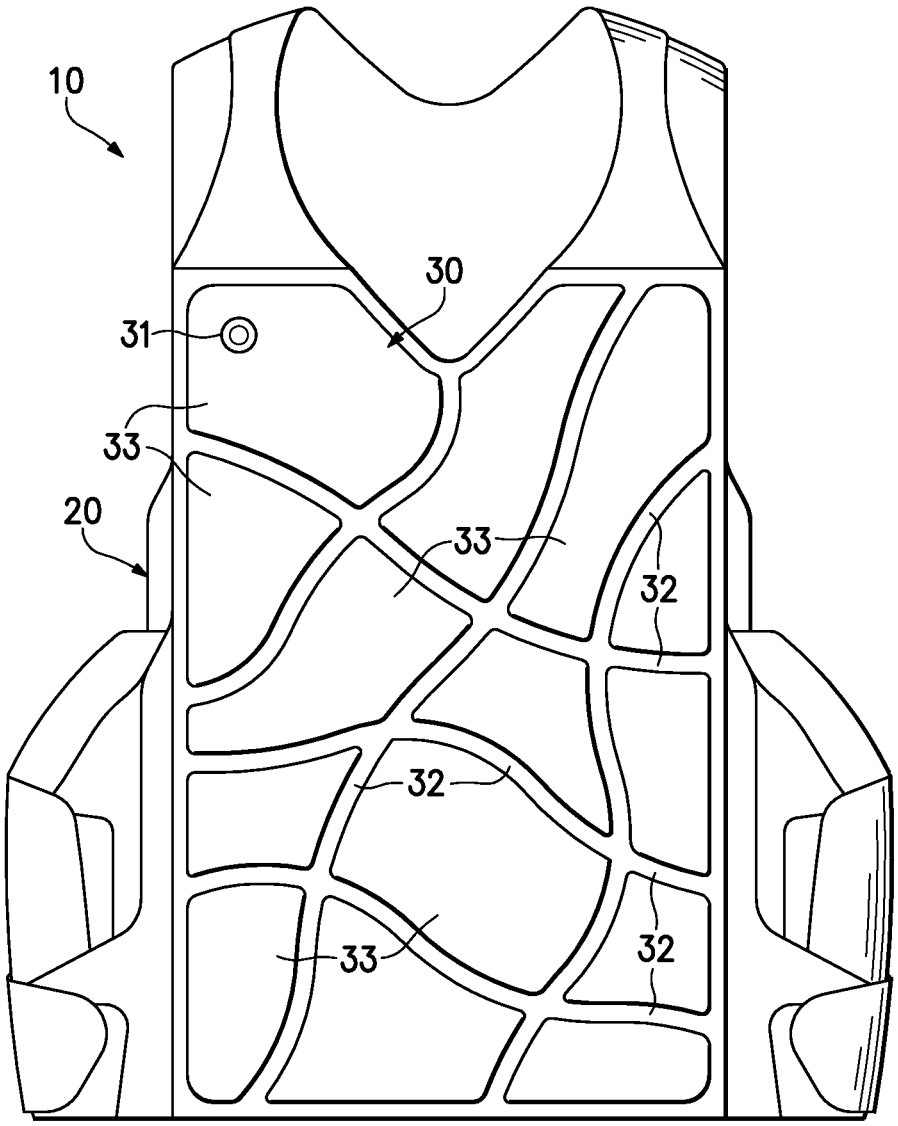

Chamber elements 30 and 40 are discussed above as having triangular subchambers 33 and 34 with varying sizes and volumes. In other configurations of apparel 10, however, subchambers chamber elements 30 and 40 may have a variety of different structures. As an example, subchambers 33 are depicted as having triangular shapes with the same size and volume in FIG. 8A. Subchambers 33 may also have square shapes or hexagonal shapes, as respectively depicted in FIGS. 8B and 8C. Referring to FIG. 8D, subchambers 33 have both hexagonal and triangular shapes. In further configurations, subchambers 33 may have non-defined shapes, as depicted in FIG. 8E. Accordingly, the shapes of subchambers 33 may vary significantly to include a variety of regular and non-regular shapes.

Figure 9A:
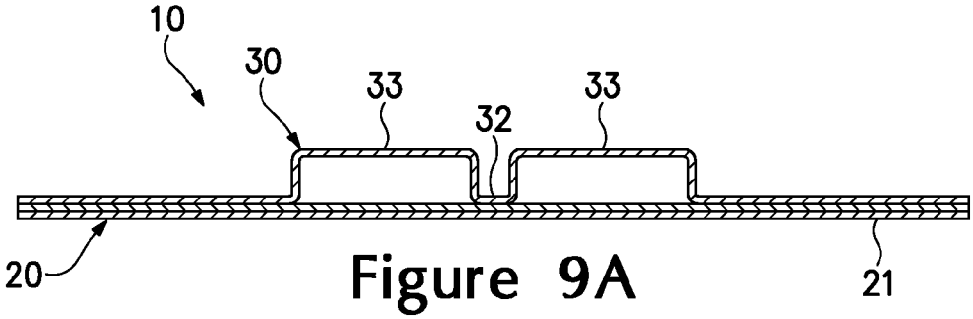
FIGS. 9A-9D are cross-sectional views corresponding with FIG. 7 and depicting additional configurations of the article of apparel.
Figure 9B:
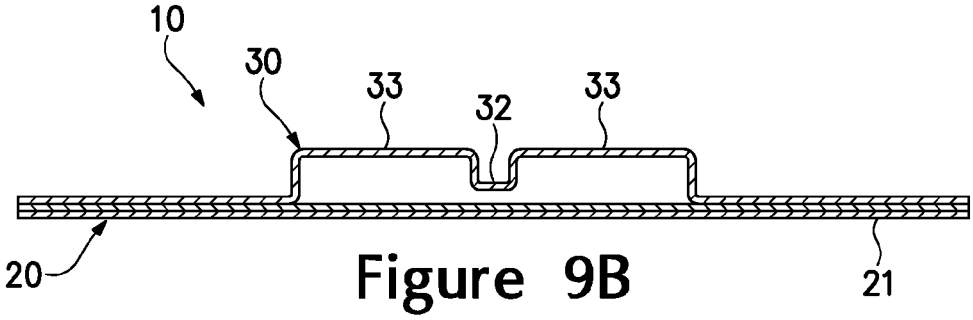
Figure 9C:
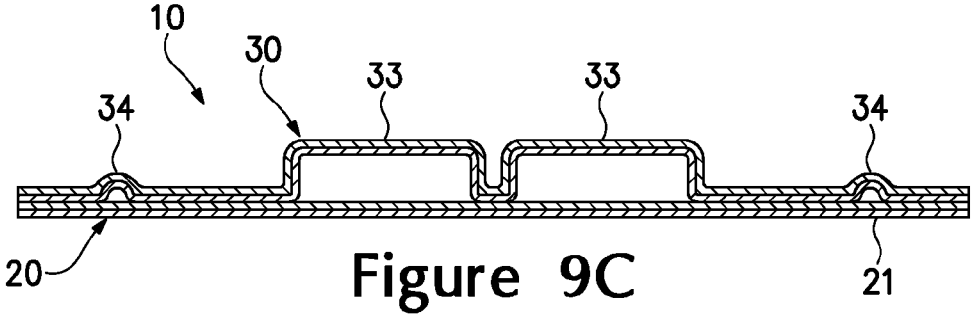
Figure 9D:
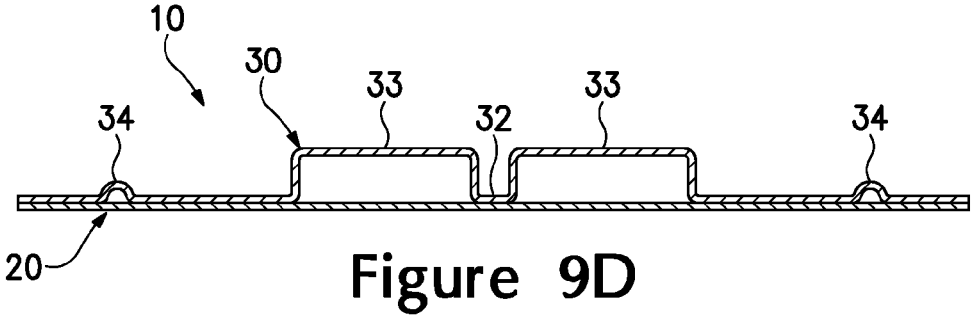

Conduits 34 permit water or other substances to flow between the various subchambers 33. In some configurations, conduits 34 may be absent such that subchambers 33 are isolated from fluid communication, as depicted in FIG. 9A. That is, subchambers 33 may be sealed such that a substance within a particular subchamber 33 remains within that subchamber 33. In another configuration, the portions of front chamber element 30 forming indentations 32 may not be bonded to the opposite surface, as depicted in FIG. 9B. The substance within front chamber element 30 may pass, therefore, behind indentations 32 to enter and fill the various subchambers 33. Although front chamber element 30 may be exposed, thereby forming an exterior surface of apparel 10, other elements may be located to cover front chamber element 30, as depicted in FIG. 9C, to enhance the aesthetic characteristics of apparel 10 or provide further insulation for front chamber element 30. In further configurations, substrate element 20 may be absent to place front chamber element 30 in direct contract with the individual.

Figure 10A:
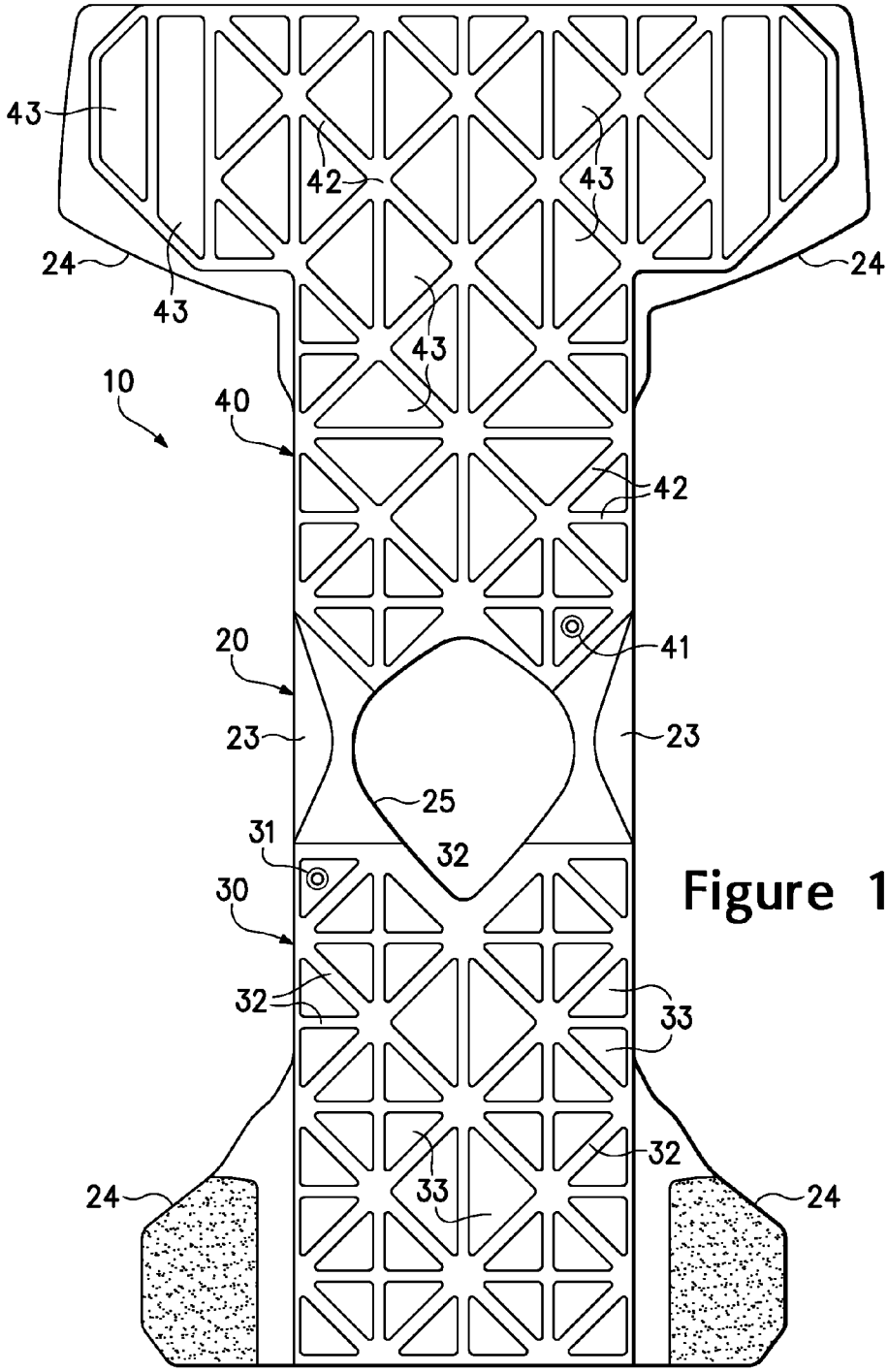
FIGS. 10A-10C are top plan views corresponding with FIG. 5 and depicting additional configurations of the article of apparel.
Figure 10B:
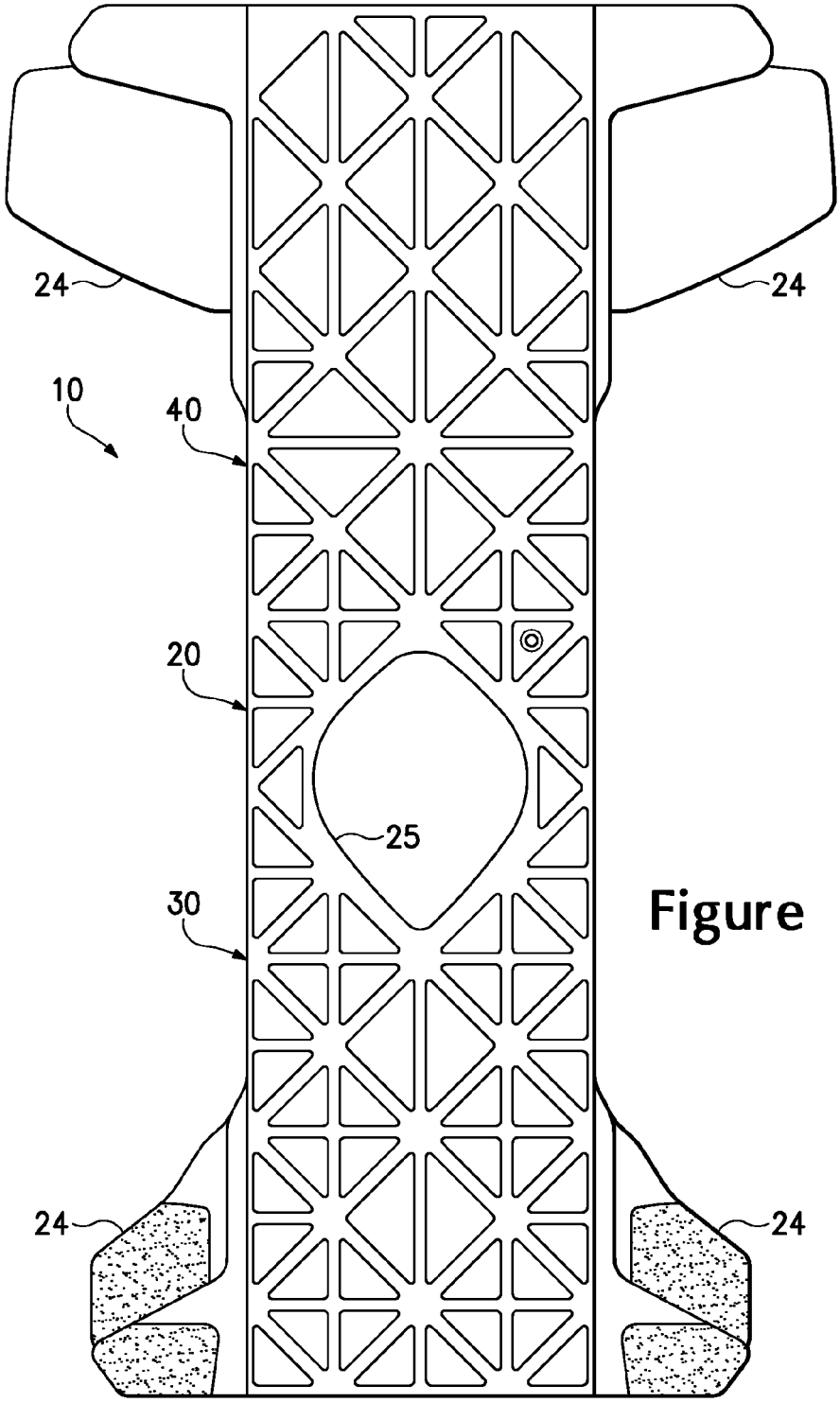

Chamber elements 30 and 40 are depicted as covering the front and rear torso areas of the individual, but are absent from the side torso areas of the individual. In some configurations one or both of chamber elements 30 and 40 may wrap onto side areas 24 of substrate element 20 to cover a greater surface area of the individual. As an example, rear chamber element 40 is depicted as having extensions that extend onto side areas 24 (i.e., over flaps 28*b* and 28*d*) in FIG. 10A. Chamber elements 30 and 40 may also be formed as a single chamber. As an example, chamber elements 30 and 40 are connected and extend over shoulder areas 23, as depicted in FIG. 10B. In addition to connecting chamber elements 30 and 40, this configuration has an advantage of also covering a greater surface area of the individual.

Figure 10C:
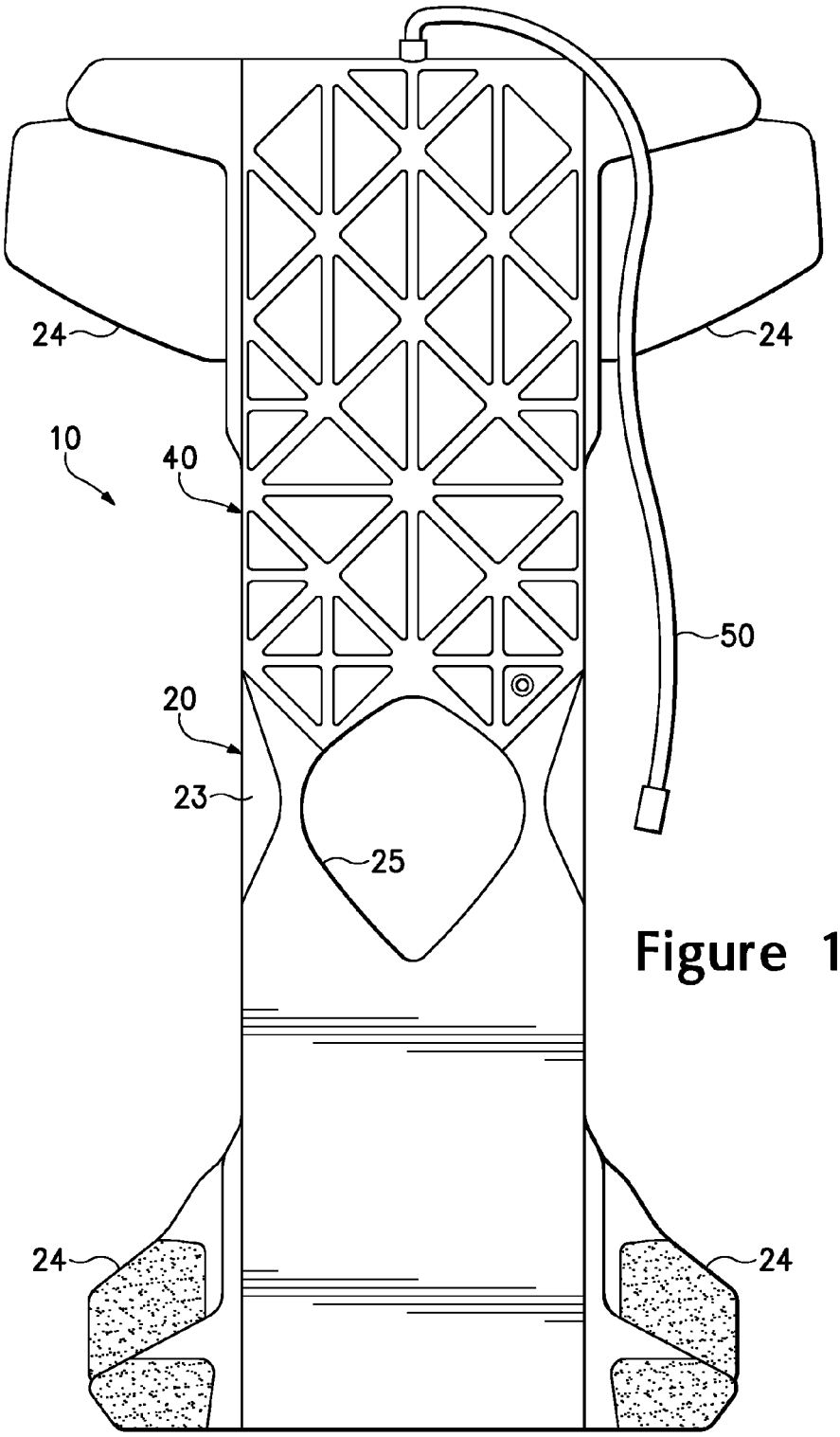

The discussion above demonstrates one method by which apparel 10 may be utilized to moderate the body temperature of the individual. More particularly, the above discussion indicates that apparel 10 may be heated or cooled and then worn by the individual to increase or decrease the body temperature of the individual. Another method by which apparel 10 may be utilized to moderate the body temperature of the individual is through introducing fluids into the individual. Referring to FIG. 10C, apparel 10 is depicted in a configuration wherein front chamber element 30 is absent and a drinking tube 50 extends from a lower part of rear chamber element 40 to one of shoulder areas 23. If apparel 10 is worn during athletic activities, the individual may draw water from rear chamber element 40 through tube 50, thereby ingesting the water to provide hydration.

Figure 11:
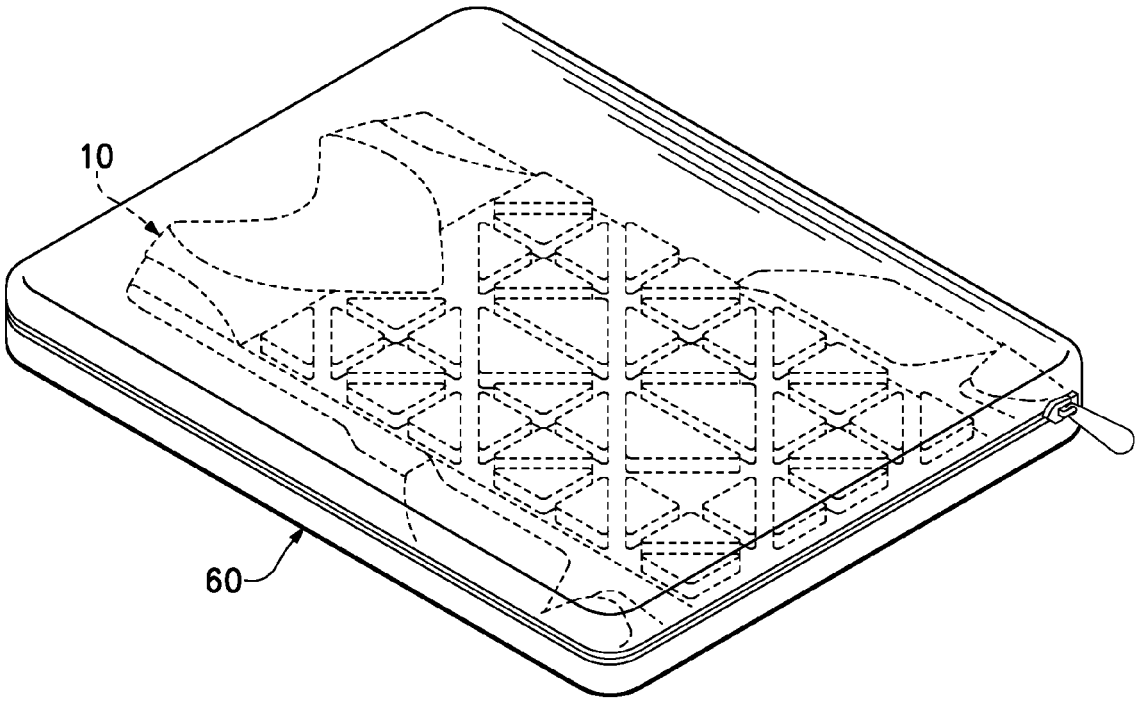
FIG. 11 is a perspective view of an insulative container and the article of apparel located within the container.

Refrigerators, freezers, or other cooling devices may be used to cool the water within apparel 10. Similarly, stoves, microwaves, or other heating devices may be used to heat the water within apparel 10. In general, these devices may be physically-separated from a venue that hosts an athletic activity, thereby requiring apparel 10 to be transported to the venue. Moreover, relatively long periods may pass between the time when these devices are used to cool or heat the water and the time when the individual utilizes apparel 10. An insulative device 60, as depicted in FIG. 11, may be used in order to retain the temperature of apparel 10 during transport or over relatively long periods of time. More particularly, apparel 10 may be placed within insulative device 60 in order to ensure that apparel 10 remains at a desired temperature. Although insulative device 60 is depicted as having a configuration that holds one of apparel 10, other configurations may hold multiple articles of apparel 10. Suitable insulating materials for insulative device 60 include foams, fiberglass, and porous solids manufactured by NanoPour, Incorporated of Albuquerque, N. Mex., United States, for example.

Figure 12A:
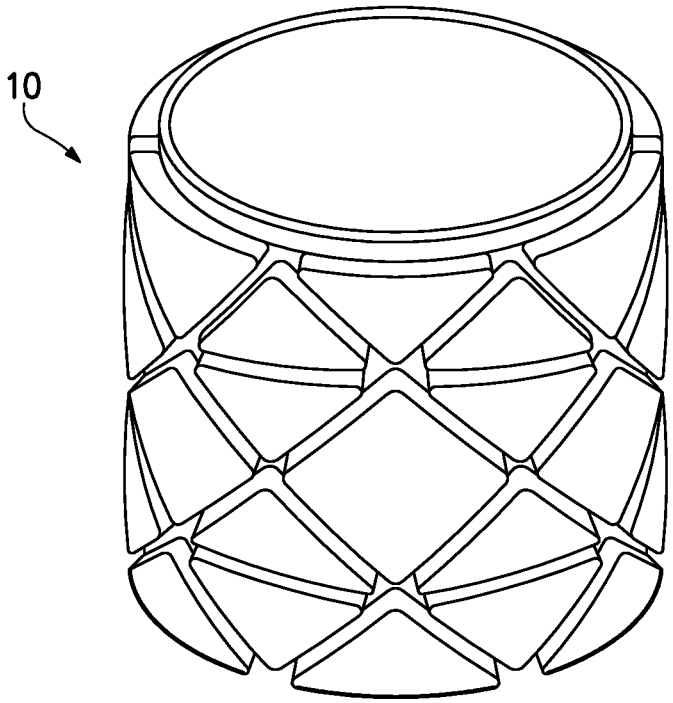
FIGS. 12A-12C are perspective views of additional articles of apparel for temperature moderation.
Figure 12B:
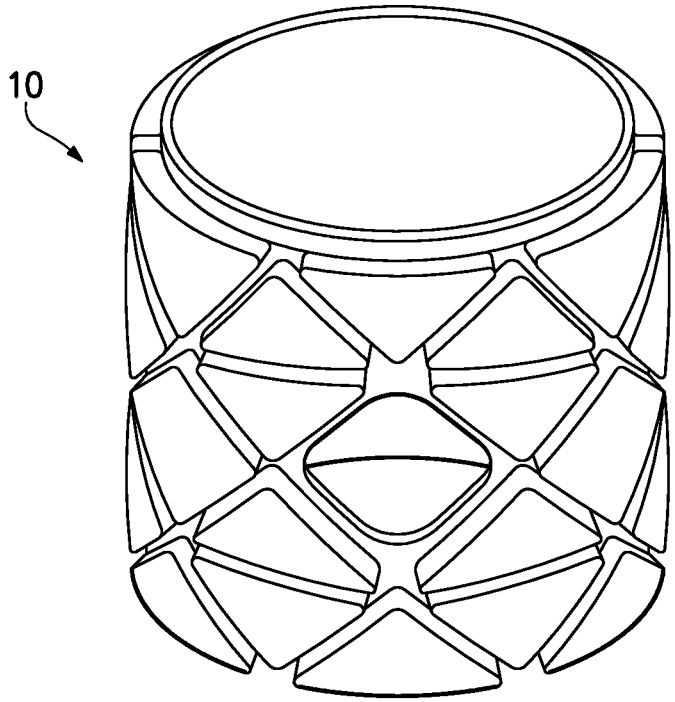
Figure 12C:
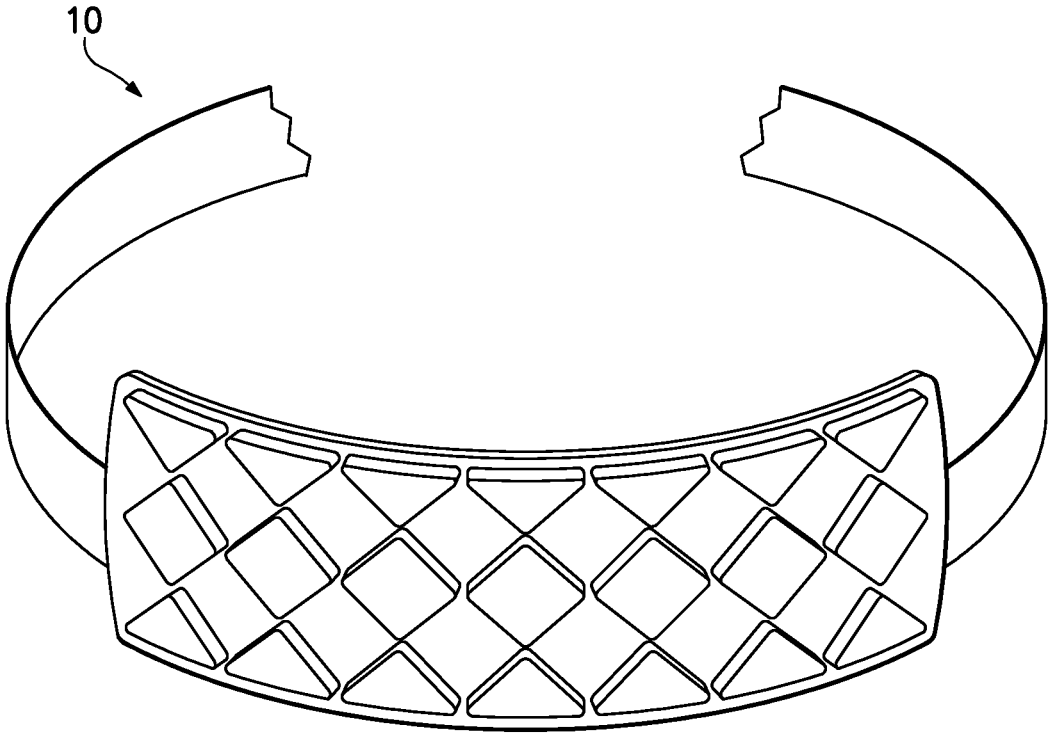

Apparel 10 is discussed above as having the configuration of a vest. Apparel 10 may also have the configuration of a shirt or jacket, and may be incorporated into headwear, pants, shorts, and footwear, for example. In addition, apparel 10 may have a configuration that provides a therapeutic covering or brace for a neck, elbow, knee, ankle, or spine, for example. Referring to FIG. 12A, apparel 10 has a configuration of a cylindrical sleeve that may extend over an arm or leg of the individual. In situations where heating or cooling may benefit the arm or leg, apparel 10 may be utilized to provide the heating or cooling. In order to accommodate an elbow or knee, apparel 10 includes an aperture in FIG. 12B. In addition to providing heating and cooling, this configuration may also assist with stabilizing or bracing the elbow or knee. A further configuration is depicted in FIG. 12C, wherein apparel 10 may apply heating or cooling to the lower back of the individual. Accordingly, the specific configuration of apparel 10 may vary significantly.

The invention is disclosed above and in the accompanying drawings with reference to a variety of embodiments. The purpose served by the disclosure, however, is to provide an example of the various features and concepts related to the invention, not to limit the scope of the invention. One skilled in the relevant art will recognize that numerous variations and modifications may be made to the embodiments described above without departing from the scope of the present invention, as defined by the appended claims.

The invention claimed is:

1. An article of apparel for transferring heat to or from a body of an individual, the article of apparel covering a portion of a torso of the individual, and the article of apparel comprising:

a front torso portion for covering a front area of the torso, the front torso portion including a front chamber element that defines a first interior void for containing a substance in either a liquid or a solid state, the front chamber element having a plurality of triangular subchambers; and a rear torso portion for covering a rear area of the torso, the rear torso portion including a rear chamber element that defines a second interior void for containing a substance in either a liquid or a solid state, the front chamber element having a plurality of triangular subchambers, wherein an average size of the triangular subchambers of the rear chamber element is greater than an average size of the triangular subchambers of the front chamber element, and wherein at least one of the front chamber element and the rear chamber element has a first surface in which a plurality of indentations are formed that define the triangular subchambers in the corresponding chamber element, portions of the indentations being unbonded to an opposite second surface of the corresponding chamber element, and each of the plurality of indentations forms a flexion line extending entirely across the corresponding chamber element.

2. The article of apparel recited in claim 1, wherein at least two of the subchambers from each of the front chamber element and the rear chamber element have different volumes.

3. The article of apparel recited in claim 1, wherein the triangular subchambers of the front chamber element are in fluid communication.

4. The article of apparel recited in claim 1, wherein the front chamber element includes a first opening for introducing a fluid into the first interior void and removing the fluid from the first interior void, and the rear chamber element includes a second opening for introducing a fluid into the second interior void and removing the fluid from the second interior void.

5. The article of apparel recited in claim 1, wherein at least one of the front chamber element and the rear chamber element has a plurality of indentations that define the triangular subchambers in the corresponding chamber element, the indentations including a first indentation, a second indentation, and a third indentation that extend in different directions, and wherein least two of the first indentation, the second indentation, and the third indentation extend entirely across the corresponding chamber element.

6. An article of apparel for covering a portion of a torso of an individual, the article of apparel comprising:

a front torso portion for covering a front area of the torso, the front torso portion including a front chamber element with a plurality of triangular subchambers; and a rear torso portion for covering a rear area of the torso, the rear torso portion including a rear chamber element with a plurality of triangular subchambers, wherein at least one of the front chamber element and the rear chamber element has a first surface in which a plurality of indentations are formed that define the triangular subchambers in the corresponding chamber element, portions of the indentations being unbonded to an opposite second surface of the corresponding chamber element, and each of the plurality of indentations forms a flexion line extending entirely across the corresponding chamber element.

7. The article of apparel recited in claim 6, wherein at least two of the subchambers from each of the front chamber element and the rear chamber element have different volumes.

8. The article of apparel recited in claim 6, wherein the triangular subchambers of the front chamber element are in fluid communication.

9. The article of apparel recited in claim 6, wherein an average size of the triangular subchambers of the front chamber element is greater than an average size of the triangular subchambers of the rear chamber element.

10. The article of apparel recited in claim 6, wherein portions of the indentations are bonds between the first surface and the second surface of the corresponding chamber element.

11. The article of apparel recited in claim 6, wherein the front chamber element defines a first interior void for containing a substance in either a liquid or a solid state, and the rear chamber element defines a second interior void for containing a substance in either a liquid or a solid state.

12. The article of apparel recited in claim 11, wherein the front chamber element includes a first opening for introducing a fluid into the first interior void and removing the fluid from the first interior void, and the rear chamber element includes a second opening for introducing a fluid into the second interior void and removing the fluid from the second interior void.

13. The article of apparel recited in claim 6, wherein at least two indentations of the plurality of indentations extend in different directions.

14. An article of apparel for covering a portion of a torso of an individual, the article of apparel comprising:

a front torso portion for covering a front area of the torso, the front torso portion including a front chamber element with a plurality of triangular subchambers; and a rear torso portion for covering a rear area of the torso, the rear torso portion including a rear chamber element with a plurality of triangular subchambers, wherein at least one of the front chamber element and the rear chamber element has a first surface in which a plurality of indentations are formed that define the triangular subchambers in the corresponding chamber element, portions of the indentations being unbonded to an opposite second surface of the corresponding chamber element, and each of the plurality of indentations forms a flexion line extending entirely across the corresponding chamber element, and wherein the indentations include a first indentation, a second indentation, and a third indentation that extend entirely across the corresponding chamber element in different directions.

15. The article of apparel recited in claim 14, wherein at least two of the subchambers from each of the front chamber element and the rear chamber element have different volumes.

16. The article of apparel recited in claim 14, wherein the triangular subchambers of the front chamber element are in fluid communication.

17. The article of apparel recited in claim 14, wherein an average size of the triangular subchambers of the front chamber element is greater than an average size of the triangular subchambers of the rear chamber element.

18. The article of apparel recited in claim 14, wherein the first indentation extends across the chamber element in a horizontal direction, the second indentation extends across the chamber element in a vertical direction, and the third indentation extends across the chamber element in a diagonal direction.

19. The article of apparel recited in claim 14, wherein the front chamber element defines a first interior void for containing a substance in either a liquid or a solid state, and the rear chamber element defines a second interior void for containing a substance in either a liquid or a solid state.

20. The article of apparel recited in claim 19, wherein the front chamber element includes a first opening for introducing a fluid into the first interior void and removing the fluid from the first interior void, and the rear chamber element includes a second opening for introducing a fluid into the second interior void and removing the fluid from the second interior void.

* * * * *